United States Patent [19]

Stoutenberg

[11] 4,039,013

[45] Aug. 2, 1977

[54] HAND TOOL WITH HELICAL DRIVE

[75] Inventor: Carl C. Stoutenberg, Avon, Conn.

[73] Assignee: The Stanley Works, New Britain, Conn.

[21] Appl. No.: 658,731

[22] Filed: Feb. 17, 1976

Related U.S. Application Data

[63] Continuation-in-part of Ser. No. 508,255, Sept. 23, 1974, abandoned.

[51] Int. Cl.[2] ..... B25B 17/00

[52] U.S. Cl. ..... 145/53

[58] Field of Search ..... 145/53, 54

[56] References Cited

U.S. PATENT DOCUMENTS

| | | | |
|---|---|---|---|
| 402,538 | 4/1889 | Olson | 145/53 |
| 430,901 | 6/1890 | True | 145/53 |
| 432,729 | 7/1890 | Goodell et al. | 145/53 |
| 529,401 | 11/1894 | McCoy et al. | 145/53 |
| 591,097 | 10/1897 | Goodell et al. | 145/54 |
| 887,423 | 5/1908 | Pratt | 145/54 |
| 974,845 | 11/1910 | Unger | 145/53 X |
| 1,054,142 | 2/1913 | Plein | 145/53 |

FOREIGN PATENT DOCUMENTS

| | | | |
|---|---|---|---|
| 449,177 | 12/1912 | France | 145/53 |
| 1,058,940 | 11/1953 | France | 145/53 |
| 455,567 | 2/1928 | Germany | 145/53 |

*Primary Examiner*—James L. Jones, Jr.
*Assistant Examiner*—J. T. Zatarga

[57] ABSTRACT

A hand tool providing for helical drive of tool bits is fabricated from a handle providing a coaxial bore with an abutment shoulder at one end, and a guide member having a helical rib along a bore extending therethrough is firmly seated in the open end of the bore. A drive spindle having a cooperating helical thread on its outer surface is slidably seated in the guide member and has its inner end engaged to limit its movement outwardly from the guide member. In the handle bore is provided a compression spring assembly which biases the spindle outwardly of the guide member.

The tool is readily assembled by inserting the drive spindle into the guide member and locking it thereon and then driving the partially ribbed guide member into the bore of the handle after the compression spring assembly has been inserted therein.

8 Claims, 6 Drawing Figures

HAND TOOL WITH HELICAL DRIVE

CROSS-REFERENCE TO RELATED APPLICATION

The present application is a continuation-in-part of copending application, Ser. No. 508,255 filed Sept. 23, 1974 now abandoned.

BACKGROUND OF THE INVENTION

Hand tools with helical drive mechanisms are widely employed for driving tool bits such as screwdriver blades, drill bits, sockets and the like. The user is able to apply axial force on the tool handle which produces rotation of the drive shank or spindle as it moves upwardly into a bore in the handle against the biasing action of a spring therewithin. To effect the rotational movement of the shank in response to the axial pressure, it has been customary to employ a tubular element which has a helical groove formed along a bore therewithin and a helical thread on the drive shank or spindle.

Generally, the assembly for such tools has included an elongated tubular member designed to fit within a bore in the handle and having the helical groove portion at its outer end, most usually in a separate element assembled therewithin. The compression spring is disposed within the tubular element and a spring guide member is also usually provided therewithin. In assembling the tool, the tubular element, spring member and helical nut member are assembled together with the drive shank. This entire subassembly is then inserted into the bore of the handle.

It is an object of the present invention to provide a hand tool with a helical drive which uses a minumum of parts and which may be readily assembled.

It is also an object to provide such a hand tool which may be fabricated relatively economically and which is durable in operation.

Another object is to provide a method for rapidly assembling hand tools with helical drives from a minimum of parts.

SUMMARY OF THE INVENTION

It has now been found that the foregoing and related objects may be readily attained in a hand tool providing a helical drive mechanism by a combination including an integrally formed synthetic resin handle having an elongated bore of generally circular cross section extending coaxially inwardly from one end thereof with a transversely extending abutment shoulder at its inner end. Firmly engaged with the wall of the handle defining the outer end of the bore is a guide member of generally circular cross section having a bore extending coaxially therethrough, and the wall of the guide member defining the bore has a helical thread extending along the length thereof. The guide member has axially extending ribs about the periphery thereof terminating inwardly of the outer end thereof to provide a circumferential collar about the outer end thereof, and the handle bore has an enlarged diameter portion at the outer end thereof providing a circumferential shoulder. The collar on the guide member abuts the handle shoulder to limit movement of the guide member inwardly of the handle bore, and the ribs interlock with the material of the handle to prevent relative rotation. A drive spindle of generally circular cross section has a cooperating helical thread extending along the outer surface thereof, and has its inner end extending through the guide member with the helical threaded thereof slidably engaged with the helical thread of the guide member. In the bore of the handle inwardly of the guide member and spindle is compression spring means including a compression spring having one end abutting against the abutment shoulder at the inner end of the bore in the handle. The other end of the spring means biases the spindle outwardly of the bore in the guide member. To limit movement of the spindle outwardly of the guide member, locking means engages the inner end of the spindle.

In the preferred embodiment of the present invention, the means effecting engagement of the inner end of the spindle is conveniently a locking member on the inner end of the spindle which has a tranverse dimension larger than the width of the bore through the guide member to act as a stop to limit outward movement of the spindle by abutment against the inner end of the guide member. The compression spring means desirably includes a spring guide in the handle bore bearing upon the inner end of the spindle and the adjacent end of the spring abuts there against. The spring guide means conveniently has a head portion adjacent its outer end a shank portion of lesser diameter so as to provide a transverse shoulder on the inner surface on the inner of the head portion. The compression spring means is a helix disposed about the shank portion and bears at one end upon the transverse shoulder of the head portion. The opposite surface of the heat portion in turn bears upon the inner end of the spindle.

To assemble the hand tool, a handle is formed with an elongated bore extending coaxially inwardly from one end thereof which provides a transversely extending abutment shoulder at the inner end of the bore. A guide member is formed with a bore extending coaxially therethrough and the wall surface defining the bore is provided with a helical groove extending along the length thereof. The guide member is formed with axially extending ribs on its outer surface which terminate inwardly from one end to provide a circumferential collar about the one end. A drive spindle of generally circular cross section is formed with a helical thread extending along the outer surface thereof, which is cooperatively dimensioned with respect to the helical groove of the guide member. One end of the drive spindle is inserted into the bore of the guide member, and a locking member is affixed to the end of said spindle to lock the drive spindle in assembly with the guide member to limit outward axial movement. Into the bore of the handle is inserted a compression spring means including a compression spring which has one end abutting against the abutment shoulder at the inner end of the bore in the handle. In the bore of the handle is then driven the subassembly of the guide member and drive spindle whereby the compression spring means biases the drive spindle outwardly of the bore in the guide member. In so doing, the ribs are embedded in the synthetic of the handle and the collar limits further movement of the guide member inwardly of the bore.

DETAILED DESCRIPTION OF THE ILLUSTRATED EMBODIMENT

Figure 1:
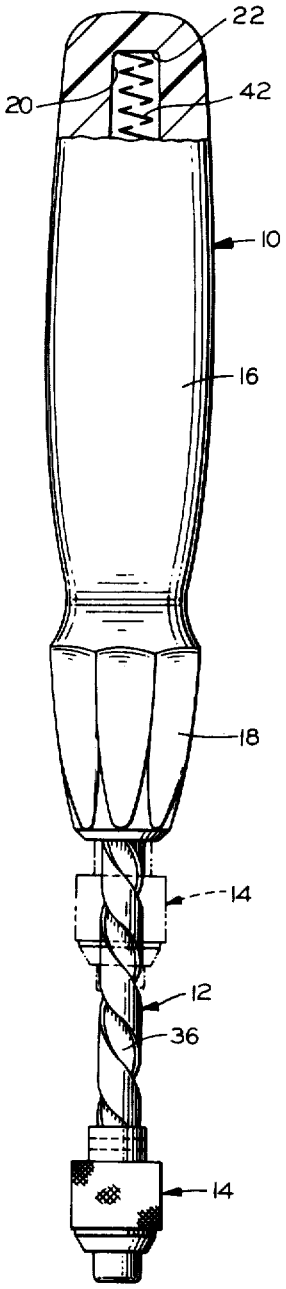
FIG. 1 is a side elevational view of a hand tool with a helical drive embodying the present invention, with a portion of the handle partially in section to reveal internal construction and with the spindle and chuck assembly shown in an axially displaced position in phantom line.
Figure 2:
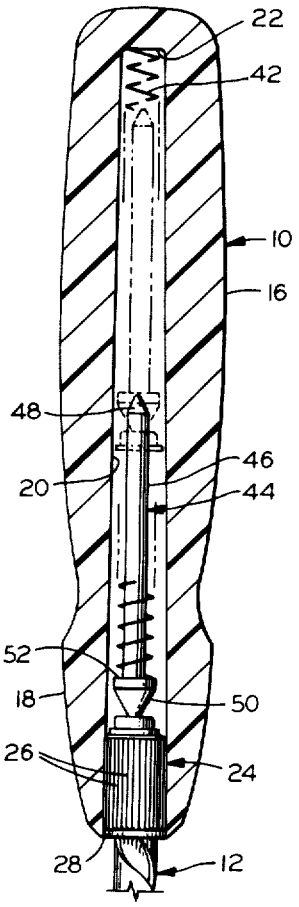
FIG. 2 is a fragmentary sectional view of the handle portion of the hand tool of FIG. 1 with the spring guide means and spindle shown in axially displaced position in phantom line.
Figure 3:
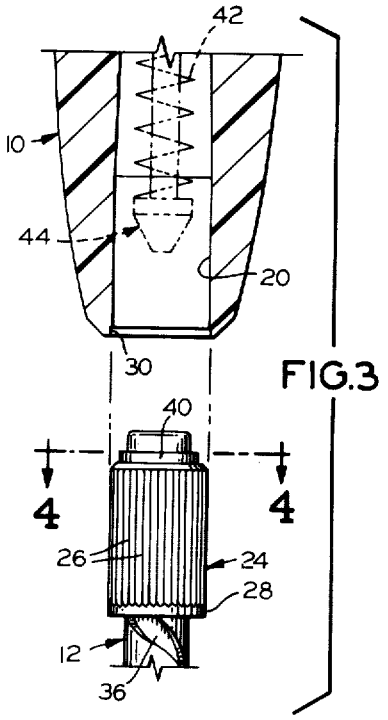
FIG. 3 is a fragmentary sectional view to a scale enlarged from that in FIG. 2 showing the spindle and guide subassembly removed from the handle bore and the spring guide member and spring in phantom line.
Figure 4:
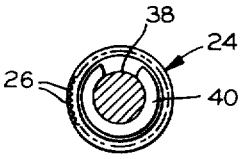
FIG. 4 is a sectional view along the line 4—4 of FIG. 3.
Figure 5:
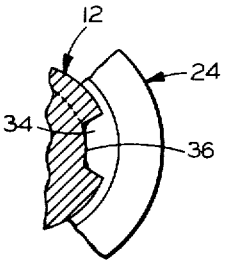
FIG. 5 is a fragmentary bottom view of the guide member spindle subassembly.
Figure 6:
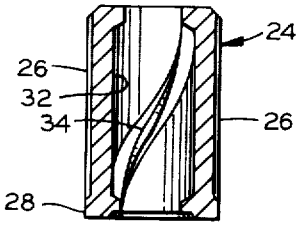
FIG. 6 is a vertical sectional view of the guide member.

Turning now in detail to the attached drawing, therein illustrated is a hand tool embodying the present invention and comprised of a synthetic resin handle generally designated by the numeral 10, a drive spindle generally designated by the numeral 12 and the chuck assembly generally designated by the numeral 14. The handle 10 is integrally formed with an elongated body portion 16 of generally circular cross section and a fluted end portion 18. A bore 20 of generally circular cross section extends coaxially inwardly of the handle 10 from the end providing the fluted end portion 18 and terminates at a point spaced inwardly from the opposite end of the handle 10 so as to provide a transversely extending shoulder 22 at its inner end.

Wedged securely in the outer end of the bore 20 is a guide member generally designated by the numeral 24 and having a generally circular cross section with axially extending shallow ribs 26 about the circumference thereof to grip firmly the synthetic resin of the handle 10 to prevent relative rotational movement. About the outer end of the guide member 24 is a circumferential collar 28 which seats on the annular shoulder 30 of the handle 10 about the outer end of the bore 20 so as to limit relative inward movement. The guide member 24 also has a bore 32 of generally circular cross section extending coaxially therethrough, and the surface defining the bore 32 thereof is provided with a pair of diametrically spaced helically extending ribs 34.

In the illustrated embodiment, the shallow ribs 26 are formed by cutting grooves in a workpiece of uniform diameter for most of the length thereof and terminating the groove cutting inwardly from the inwardly from the intended outer end of provide the circumferential collar 28. Slidably seated for helical movement within the guide member 24 is the spindle 12 which has a generally circular cross section and is provided with a helical groove 36 cooperatively dimensioned and configured to slidably seat therein the helical ribs 34 of the guide member 24. Thus, a force applied at the outer end of the spindle 12 will move it helically through the guide member 24 into the bore 20 of the handle 10. Adjacent the inner end of the spindle 12 is a circumferential groove 38 in which is seated a lock washer 40 to limit movement of the spindle 12 outwardly of the guide member 24.

Biasing the spindle 12 outwardly against the guide member 24 is a helical compression spring 42 disposed about the spring plug or guide generally designated by the numeral 44. The spring guide 44 has an elongated shank 46, a conical inner end 48 and a head portion 50 of enlarged diameter relative to the shank 46 so as to provide a radially extending shoulder 52 at the outer end of the shank 46. The helical spring 42 is disposed about the shank of the spring guide member 44 and acts at one end directly upon the shoulder 22 at the inner end of the bore 20 of the handle 10 and at its outer or other end against the shoulder 52 of the spring guide 44. In turn the head portion 50 of the spring guide 44 bears upon the inner end of the spindle 12 to apply the biasing pressure there against.

At the outer end of the spindle 12 is the conventional chuck assembly 14 which is adapted to releasably engage tool bits of various types (not shown) and which, being of conventional construction, will not be discussed further.

In operation of the tool of the present invention, a tool bit (not shown) is inserted into the chuck assembly 14. The tool is then moved to place the tool bit in contact with the workpiece (not shown) and downward pressure is applied to the handle 10. The spindle 12 moves helically within the guide member 24 as its helical groove 36 slides along the helical ribs 34, causing the spring 42 to compress. After the chuck assembly 14 has abutted against the guide member 24, the downward pressure upon the handle 10 is relieved, and the spring 42 acting upon the spring guide 44 drives the spindle 12 into the initial position shown in full line in FIG. 1.

In assembling the tool of the present invention, the spindle 12 is inserted into the guide member 24 with its helical groove 36 slidably seating the helical ribs 34 thereof. The lock washer 40 is then inserted into the groove 38 adjacent the inner end of the spindle 12 and its ends are bent to maintain the members in assembly. The helical spring 42 is placed about the shank 46 of the spring guide 44 and this subassembly is inserted into the bore 20 of the handle 10. The subassembly of the spindle 12 and guide member 24 is then driven into the bore 20 and thereby locks the several elements in assembly. As the guide member 24 is driven into the bore 20, the ribs 26 embed themselves in the resin of the handle 10, and the collar 28 seats against the shoulder 30 as the resin resistance limits further movement. The chuck assembly 14 may be mounted upon the spindle 12 either before or after the assembly operation described above, but is most conveniently mounted thereon after the above described assembly operation.

As will be readily appreciated, the several components may vary in configuration from the components as illustrated in the accompanying drawing and in fact the spring guide member may be omitted if so desired by providing a shoulder upon the spindle against which the spring acts directly. Although the cross section of the guide member and bore may vary from the generally circular configuration illustrated, the use of generally circular configuration for the cross section of all the several elements of the assembly facilitates obtaining optimum alignment both during manufacture and during use.

From the foregoing detailed description and the accompanying drawing, it will be appreciated that the relatively small number of parts required by the structure of the present invention facilitates manufacturing and assembly andminimizes cost. Moreover, relatively trouble-free operation is readily attained and a long lived, durable tool may be fabricated economically.

Having thus described the invention, I claim:

1. In a hand tool for imparting rotational movement to tool bits, the combination comprising:

A. an integrally formed synthetic resin handle having an elongated bore extending coaxially inwardly from one end thereof and providing a transversely extending abutment shoulder at the inner end of said bore adjacent the other end of said handle, said bore being of generally circular cross section and having an enlarged diameter portion at said one end of said handle providing an annular circumferential shoulder at said one end;

B. a guide member of generally circular cross section in the outer end of said bore firmly engaged with the wall of said handle defining said bore, said guide member having a bore extending coaxially therethrough from the inner end to the outer end thereof with said inner end being disposed adjacent said abutment shoulder, the wall of said guide member defining said bore therethrough having a helical extending along the length of said bore, said bore member having axially extending ribs about the periphery thereof terminating inwardly of the outer end thereof to provide a circumferential collar about the outer end thereof, said ribs interlocking with the material of said handle to prevent relative rotation, said guide member collar abutting said handle bore circumferential shoulder to limit movement of said guide member inwardly of said bore:

C. a drive spindle of generally circular cross section having a cooperating helical thread extending along the outer surface thereof, said spindle having its inner end extending through said guide member with the helical thead thereof slidably engaged with the helical thread of said guide member;

D. compression spring means in said bore including a compression spring having one end abutting against said abutment shoulder at the inner end of said bore in said handle and the other end biasing said spindle outwardly of said bore in said guide member;

E. means engaging the inner end of said spindle and limiting movement outwardly of said guide member;

F. bit mounting means on the outer end of said drive spindle for detachably engaging a tool bit; and G. a bit detachably seated in said bit mounting means.

2. The hand tool in accordance with claim 1 wherein said means engaging the inner end of said spindle comprises a locking member on the inner end of said spindle having a transverse dimension larger than the width of said bore through said member, whereby said locking member acts as a stop to limit outward movement of said spindle by abutment against the inner end of said guide member.

3. The hand tool in accordance with claim 1 wherein said compression spring means includes spring guide means in said handle bore bearing upon the inner end of said spindle and said other end of said compression spring abuts against said spring guide means.

4. The hand tool in accordance with claim 3 wherein said spring guide means has a head portion adjacent its outer end and a shank portion of lesser diameter so as to define a transverse shoulder on the inner surface of said head portion and wherein said compression spring means is a helical spring disposed about said shank portion and bearing at one end upon said transverse shoulder, the opposite surface of said head portion bearing upon the inner end of said spindle

5. The hand tool in accordance with claim 1 wherein said collar of said guide member has a diameter substantially equal to the outer diameter of said axially extending ribs.

6. In a method for assembling a hand tool for imparting rotational movement to tool bits, the steps comprising:

A. forming a handle of synthetic resin with an elongated bore of generally circular cross section extending coaxially inwardly from one end thereof and providing a transversely extending abutment shoulder at the inner end of said bore, said bore having an enlarged diameter portion at said one end of said handle providing an annular circumferential shoulder at said one end;

B. forming a guide member of generally circular cross section with a bore extending coaxially therethrough and axially extending ribs about the periphery thereof extending from one end and terminating inwardly of the other end to define a circumferential collar at said other end and forming on the wall of the guide member defining said bore a helical groove extending along the length of said bore;

C. forming a drive spindle of generally circular cross section with a helical thread extending along the outer surface thereof, said helical thread being cooperatively dimensioned with respect to said helical groove of said guide member;

D. inserting one end of said drive spindle into said bore of said guide member with the helical threaded thereof slidably engaged with the helical groove of said guide member;

E. affixing a locking member to said spindle to lock said drive spindle in assembly with said guide to limit axial movement outwardly of said guide member;

F. inserting into said bore of said handle compression spring means with one end abutting against said abutment should at the inner end of said bore in said handle; and G. driving into said bore of said handle the subassembly of said guide member and drive spindle with said one end of said drive spindle entering said bore first so as to cause said resin of said handle defining the wall of said bore to deform about said axially extending ribs on said guide member and embed said ribs in said synthetic resin of said handle and thereby lock said subassembly in said bore of said handle, said collar of said guide member abutting said circumferential shoulder of said handle about said bore at said one end thereof to limit further movement of said subassembly inwardly of said handle bore whereby said compression spring means biases said drive spindle outwardly of said bore in said guide member.

7. The method of assembling a hand tool in accordance with claim 6 wherein said ribs and collar on said guide member are formed by terminating the removal of axially extending portions of a uniform diameter workpiece at a point spaced from said other end thereof, the removal providing the valleys between said ribs and the portion from which no material providing said collar.

8. The method of assembly a hand tool in accordance with claim 6 wherein said locking member is seated in a recess on the inner end of said spindle.

* * * * *